US008164406B2

(12) United States Patent
Lin et al.

(10) Patent No.: US 8,164,406 B2
(45) Date of Patent: Apr. 24, 2012

(54) TRANSFORMER

(75) Inventors: Tsai-Shen Lin, Taoyuan Hsien (TW); Wen-Pin Feng, Taoyuan Hsien (TW); Yu-Chin Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 492 days.

(21) Appl. No.: 12/046,659

(22) Filed: Mar. 12, 2008

(65) Prior Publication Data

US 2008/0211613 A1 Sep. 4, 2008

Related U.S. Application Data

(63) Continuation-in-part of application No. 11/734,504, filed on Apr. 12, 2007, now Pat. No. 7,982,576.

(30) Foreign Application Priority Data

May 26, 2006 (TW) ..... 95118733 A
Sep. 21, 2007 (TW) ..... 96135545 A

(51) Int. Cl.
*H01F 27/08* (2006.01)
*H01F 27/28* (2006.01)

(52) U.S. Cl. ..... 336/61; 336/232

(58) Field of Classification Search ..... 336/200, 336/223, 232, 61, 65, 192
See application file for complete search history.

(56) References Cited

U.S. PATENT DOCUMENTS 5,010,314 A * 4/1991 Estrov ..... 336/198
5,479,146 A * 12/1995 Herbert ..... 336/61
5,926,373 A * 7/1999 Stevens ..... 361/704
5,949,191 A * 9/1999 Cassese et al. ..... 315/82
6,069,548 A * 5/2000 Baarman et al. ..... 336/65
6,239,683 B1 * 5/2001 Roessler et al. ..... 336/200
6,429,763 B1 * 8/2002 Patel et al. ..... 336/200
6,522,233 B1 * 2/2003 Kyoso et al. ..... 336/200
6,545,890 B2 * 4/2003 Pitzele ..... 363/147
6,587,026 B2 * 7/2003 Yeh et al. ..... 336/223
6,774,755 B2 * 8/2004 Nakata et al. ..... 336/83
6,896,526 B2 * 5/2005 Pitzele ..... 439/83
6,972,657 B1 * 12/2005 Pacala et al. ..... 336/200
6,980,074 B1 * 12/2005 Jitaru ..... 336/200
6,982,876 B1 * 1/2006 Young ..... 361/719
6,995,645 B2 * 2/2006 Takiguchi et al. ..... 336/200
7,085,146 B2 * 8/2006 Pitzele ..... 363/147
7,145,179 B2 * 12/2006 Petroski ..... 257/81
7,266,003 B2 * 9/2007 Lanni ..... 363/80
7,307,341 B2 * 12/2007 Humbert et al. ..... 257/728
7,468,648 B2 * 12/2008 Springett ..... 336/200
2006/0215381 A1 * 9/2006 Lanni ..... 361/794

* cited by examiner

*Primary Examiner* — Lincoln Donovan
*Assistant Examiner* — Joselito Baisa
(74) *Attorney, Agent, or Firm* — Kirton McConkie; Evan R. Witt

(57) ABSTRACT

A transformer is provided. The transformer includes a first electrical conductor, a second electrical conductor, a circuit board and a core set. The first electrical conductor has a through hole and the second electrical conductor is electromagnetically coupled with the first electrical conductor and includes a plurality of spiral coils formed by winding a single conductive wire, each spiral coil having a through hole. The circuit board has a through hole. The core set penetrates the through hole of the first electrical conductor, the through hole of the circuit board, and the through holes of the plurality of spiral coils of the second electrical conductor, and covers at least one portion of the first electrical conductor and the second electrical conductor.

19 Claims, 5 Drawing Sheets

TRANSFORMER

FIELD OF THE INVENTION

This application is a continuation-in-part of U.S. patent application Ser. No. 11/734,504, filed on Apr. 12, 2007, and entitled "TRANSFORMER". The entire disclosures of the above application are all incorporated herein by reference.

BACKGROUND OF THE INVENTION

A transformer is an electronic assembly, which is frequently used in various electronic apparatuses for modulating different voltages in the range applicable to the power-receiving apparatuses. Referring to FIG. 1, a conventional transformer 1 includes a bobbin 11, a coil set 12, a pin seat 14 and a core 15. The coil set 12 includes a primary coil and a secondary coil each formed by winding a conductive wire around a winding region 111 of the bobbin 11. The primary coil is electromagnetically coupled with the secondary coil. The pin seat 14 is connected with the bobbin 11 and includes a plurality of pins 141, which is for electrically connecting with a circuit board 17. The core 15 is composed of a first core 151 and a second core 152, which are respectively fit with two ends of the bobbin 11 and are connected together to form an electromagnetic loop.

In general, the coil set is made in the form of concentric or stacked winding. The concentric coil set 12 is directly wound around the bobbin 11, while the stacked winding structure has a primary coil and a secondary coil each wound to form a wire cake 20, as shown in FIG. 2, and then the wire cakes 20 are alternately arranged along an axial direction of the bobbin 11 and then fit with the bobbin 11. The conventional wire cake 20 is a single-layer spiral wire cake formed by spirally winding a conductive wire outward on a plane, and both ends (i.e., a beginning end 20*a* and a terminating end 20*b*) of the conductive wire are suspended outside the structure of the wire cake 20 for being electrically connected with a pin or connected to a power source. However, under large capacity and high current requirements for the transformer 1, the number of the coils is typically increased, but it takes time and cost to connect each wire cake 20.

Besides, the electronic device trends to be small and thin nowadays, the volume of the transformer has to be reduced, and the structure of the transformer needs to be simplified to facilitate assembling, application and heat-dissipation. Therefore, it is an important object to provide a transformer to achieve the foresaid objects.

SUMMARY OF THE INVENTION

It is an object of the present invention to provide a transformer for saving space, increasing application, improving heat-dissipation and reducing assembling time and cost.

In accordance with an aspect of the present invention, there is provided a transformer including a first electrical conductor, a second electrical conductor, a circuit board and a core set. The first electrical conductor has a through hole and the second electrical conductor is electromagnetically coupled with the first electrical conductor and includes a plurality of spiral coils formed by winding a single conductive wire, each spiral coil having a through hole. The circuit board has a through hole. The core set penetrates the through hole of the first electrical conductor, the through hole of the circuit board, and the through holes of the plurality of spiral coils of the second electrical conductor, and covers at least one portion of the first electrical conductor and the second electrical conductor.

BRIEF DESCRIPTION OF THE DRAWINGS

The invention will become more fully understood from the detailed description given herein below illustration only, and thus is not limitative of the present invention, and wherein.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
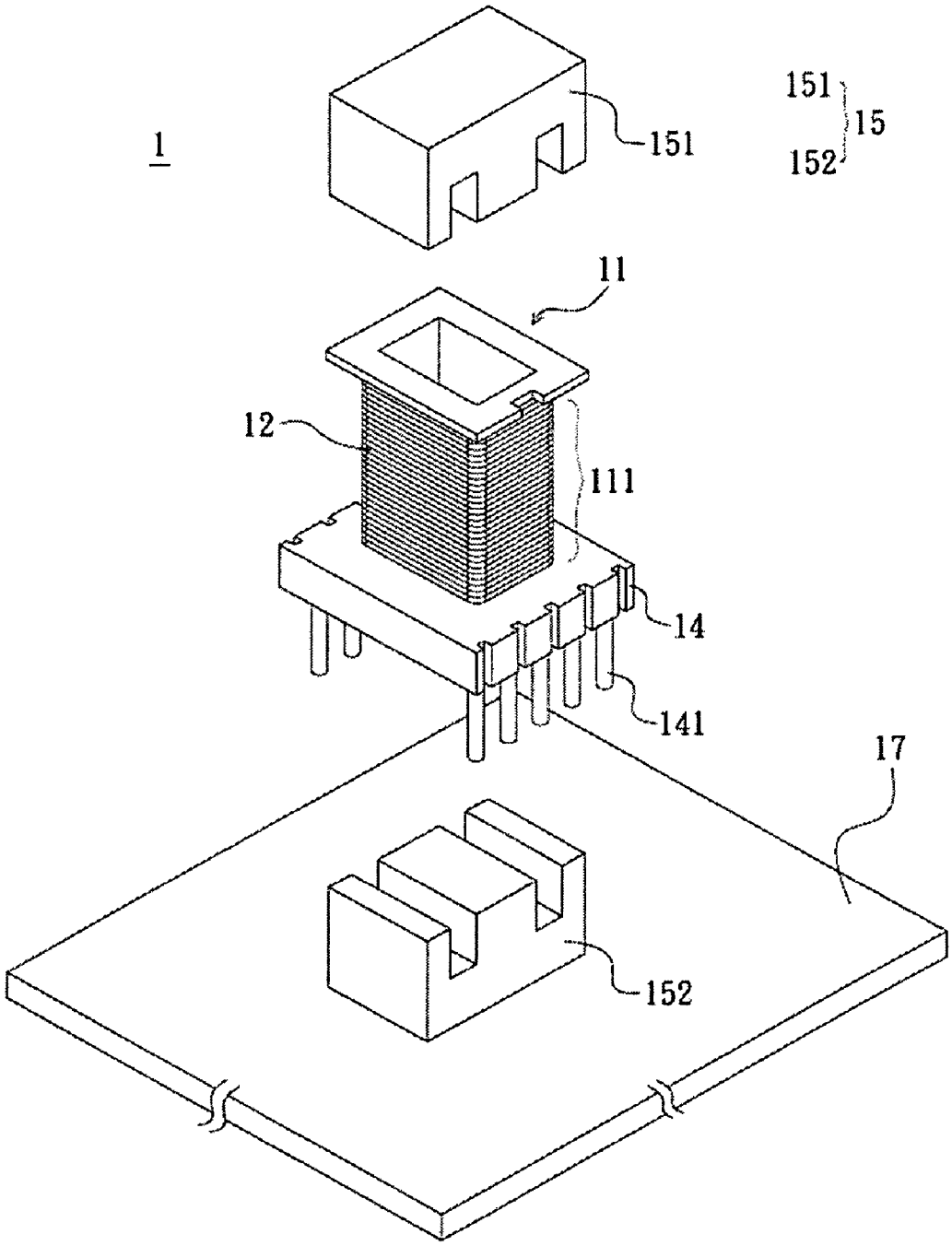
FIG. 1 PRIOR ART
FIG. 1 is a schematic illustration showing a conventional transformer.
Figure 2:
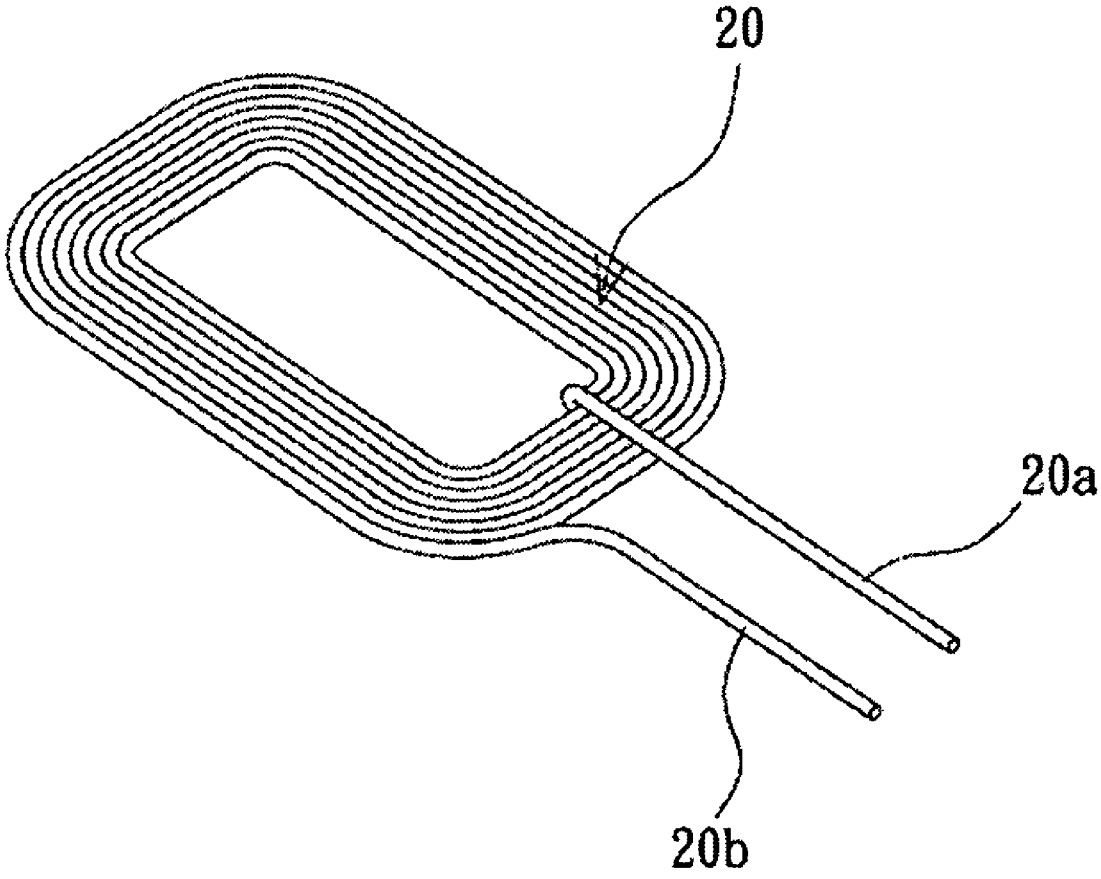
FIG. 2 PRIOR ART
FIG. 2 is a schematic illustration showing a conventional single-layer spiral wire cake.
Figure 3:
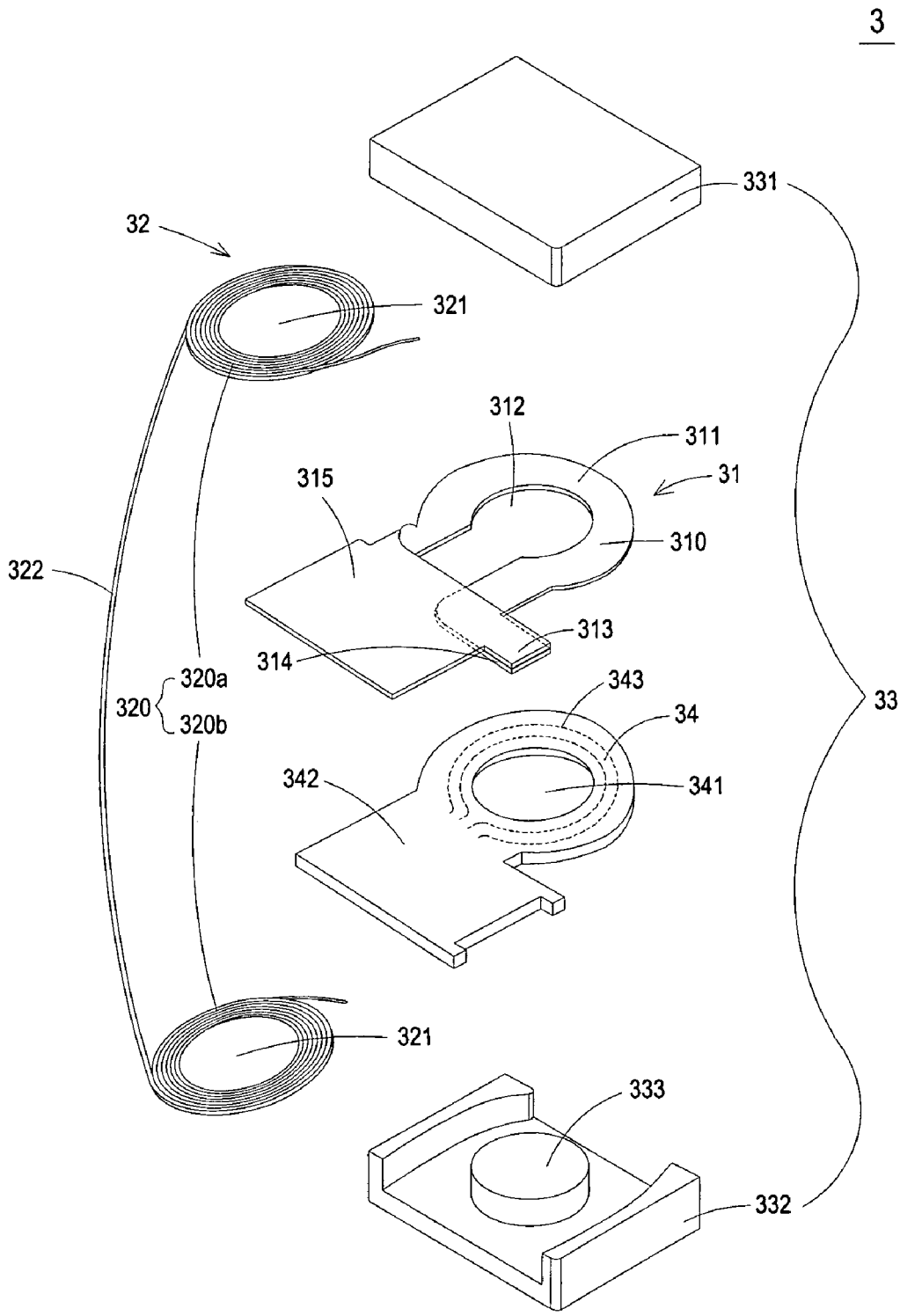
FIG. 3 is a schematic illustration showing a transformer according to a preferred embodiment of the present invention.

Please refer to FIG. 3, which is a schematic illustration showing a transformer according to a preferred embodiment of the present invention. As shown in FIG. 3, the transformer 3 includes a first electrical conductor 31, a second electrical conductor 32, a core set 33 and a circuit board 34, wherein the first electrical conductor 31 is used as a secondary coil of the transformer 3 and the second electrical conductor 32 is used as a primary coil of the transformer 3, but not limited thereto. The core set 33 penetrates the first electrical conductor 31, the second electrical conductor 32 and the circuit board 34, and covers at least one portion of the first electrical conductor 31, the second electrical conductor 32 and the circuit board 34, so that the first electrical conductor 31 is electromagnetically coupled with the second electrical conductor 32.

The first electrical conductor 31 includes at least one conductive sheet 310 having a coil part 311 and a through hole 312. The conductive sheet 310 is formed, for example, by cutting and folding a single copper piece, and the coil part 311 of the conductive sheet 310 can be single-layer or multilayer (not shown) folding structure. In some embodiments, the conductive sheet 310 further includes two pins 313, 314 and an extension part 315. The extension part 315 is integrally formed and connected with the coil part 311, and the two pins 313, 314 are respectively connected with the extension part 315 and the coil part 311 for directly or indirectly connecting with the system circuit board (not shown). In addition, the extension part 315 has a relatively wider surface for heat-dissipation and facilitating fixing and heat-dissipation of the electronic component, such as a transistor, that is disposed on the extension part 315.

The second electrical conductor 32 includes a plurality of spiral coils 320, and all of which are formed by spirally winding a single, continuous, single-core conductive wire. For example, the plurality of spiral coils 320 include a first spiral coil 320*a* and a second spiral coil 320*b*, and each of the spiral coils 320 has a through hole 321, and the adjacent spiral coils are connected via a connection part 322 directly. The conductive wire can be an enameled wire, a triple insulated wire or a self-adhesive wire, but not limited thereto. In this embodiment, each spiral coil 320 of the second electrical conductor 32 is a multilayer spiral coil. Certainly, in other embodiments, the plurality of spiral coils 320 of the second electrical conductor 32 can be single-layer spiral coils or a combination of single-layer and multilayer spiral coils.

In this embodiment, the first spiral coil 320*a* and the second spiral coil 320*b* are both multilayer spiral coils. The conductive wire is spirally wound from the periphery toward the interior and then, across to the next layer, wound from the interior toward the periphery to form the first spiral coil 320*a*. The foresaid conductive coil further extends from the periphery of the first spiral coil 320*a*, and after a connection part 322 is kept, the same conductive wire is further used to form the second spiral coil 320*b* by the similar way for forming the first spiral coil 320*a*. Thereby, the second electrical conductor 32 is formed by a single, continuous, single-core conductive wire. Certainly, the multilayer coil structures of each spiral coil 320 can be adhered together by an adhesive to avoid the multilayer coil structures being apart from each other.

The first electrical conductor 31 is electromagnetically coupled with the second electrical conductor 32. In some embodiments, the conductive sheet 310 of the first electrical conductor 31 is disposed between the plurality of spiral coils 320 of the second electrical conductor 32, such as disposed between the first spiral coil 320*a* and the second spiral coil 320*b*, and the first spiral coil 320*a* and the second spiral coil 320*b* are connected via the connection part 322. Moreover, the circuit board 34 is also disposed between the plurality of spiral coils 320 of the second electrical conductor 32, such as disposed between the first spiral coil 320*a* and the second spiral coil 320*b* and close to the first electrical conductor 31. In this embodiment, the circuit board 34 is disposed between the conductive sheet 310 of the first electrical conductor 31 and the second spiral coil 320*b* of the second electrical conductor 32. The circuit board 34 has a through hole 341 and an extension part 342. In some embodiments, the circuit board 34 further has primary and/or secondary winding coils 343 embedded therein. The core set 33 is made of magnetic material and includes a first core 331 and a second core 332. The core set 33 can be but not limited to EE-typed or EI-typed core set, and at least one of the first core 331 and the second core 332 has a central protrusion 333. The central protrusion 333 of the core set 33 penetrates the through hole 312 of the first electrical conductor 31, the through hole 321 of the second electrical conductor 32 and the through hole 341 of the circuit board 34, thereby assembling the transformer 3 of this embodiment.

Figure 4B:
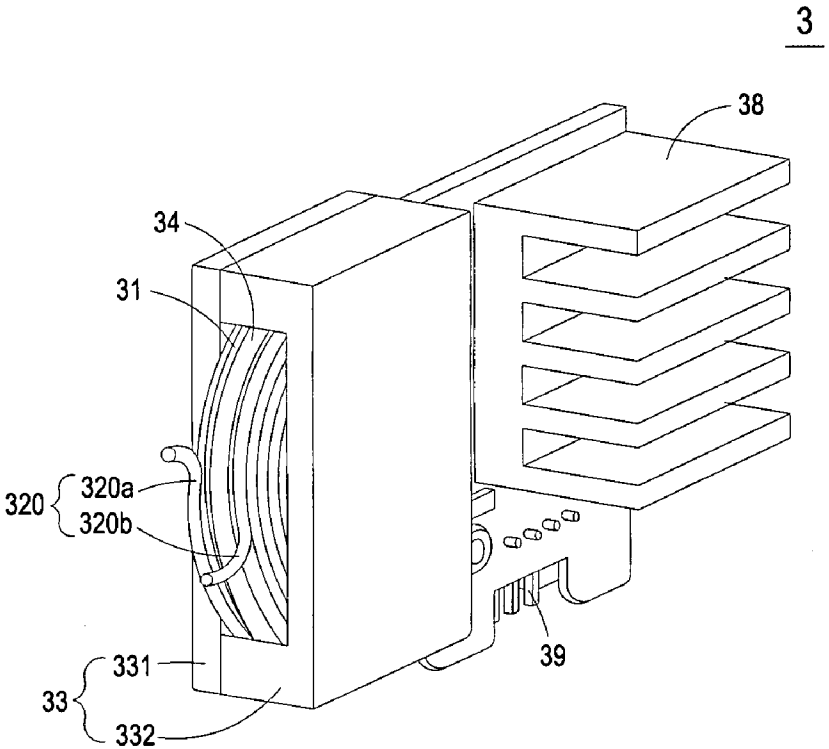
FIGS. 4A and 4B are schematic illustrations showing the transformer of FIG. 3 applied to an electronic device in different views.
Figure 4A:
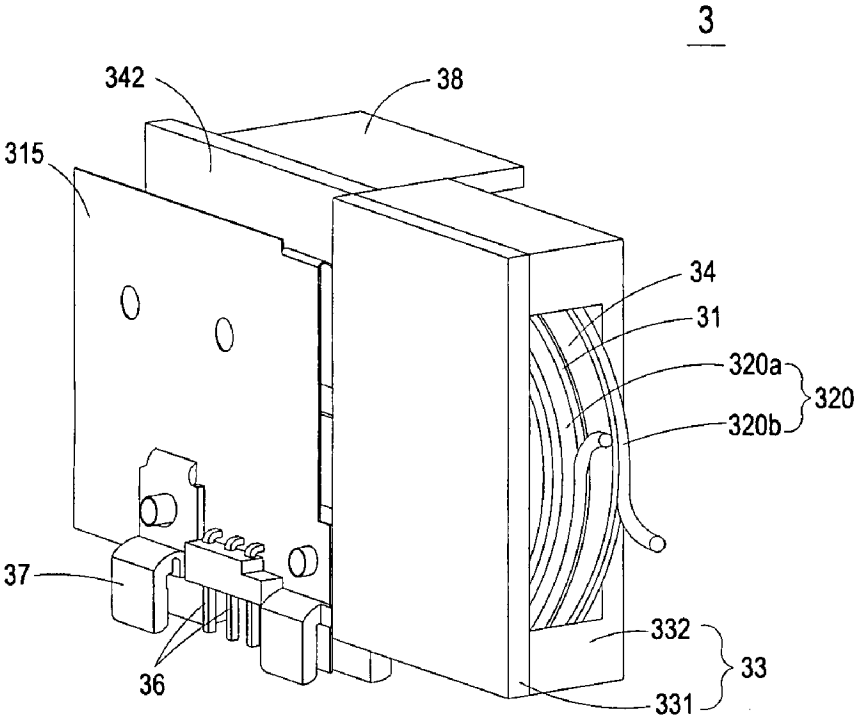

Please refer to FIGS. 4A and 4B, which are schematic illustrations showing the transformer of FIG. 3 applied to an electronic device in different views. As shown in FIGS. 4A and 4B, after the first electrical conductor 31, the second electrical conductor 32, the core set 33 and the circuit board 34 are assembled to form the transformer 3, the extension part 342 of the circuit board 34 and the extension part 315 of the first electrical conductor 31 are both exposed outside the core set 33. The extension part 342 of the circuit board 34 and the extension part 315 of the first electrical conductor 31 are substantially parallel to each other. The extension part 315 of the first electrical conductor 31 has at least one electronic component 37, such as a transistor, secured thereon and/or a plurality of pins 36 extended therefrom. Thereby, the extension part 315 of the first electrical conductor 31 facilitates the fixing and heat-dissipation of the electronic component 37 and increases the space utilization. The pins 36 on the extension part 315 of the first electrical conductor 31 are connected with the system circuit board (not shown). Further, the extension part 342 of the circuit board 34 has a power and/or signal converting or transmitting circuit (not shown) and a heat sink 38 directly disposed on a surface of the extension part 342 of the circuit board 34 for facilitating heat-dissipation of the transformer 3 and the circuit board 34. In some embodiments, the circuit board 34 has a plurality of pins 39 for connecting with the system circuit board (not shown) as the transmitting interface between the circuit board 34 and the system circuit board.

Figure 5:
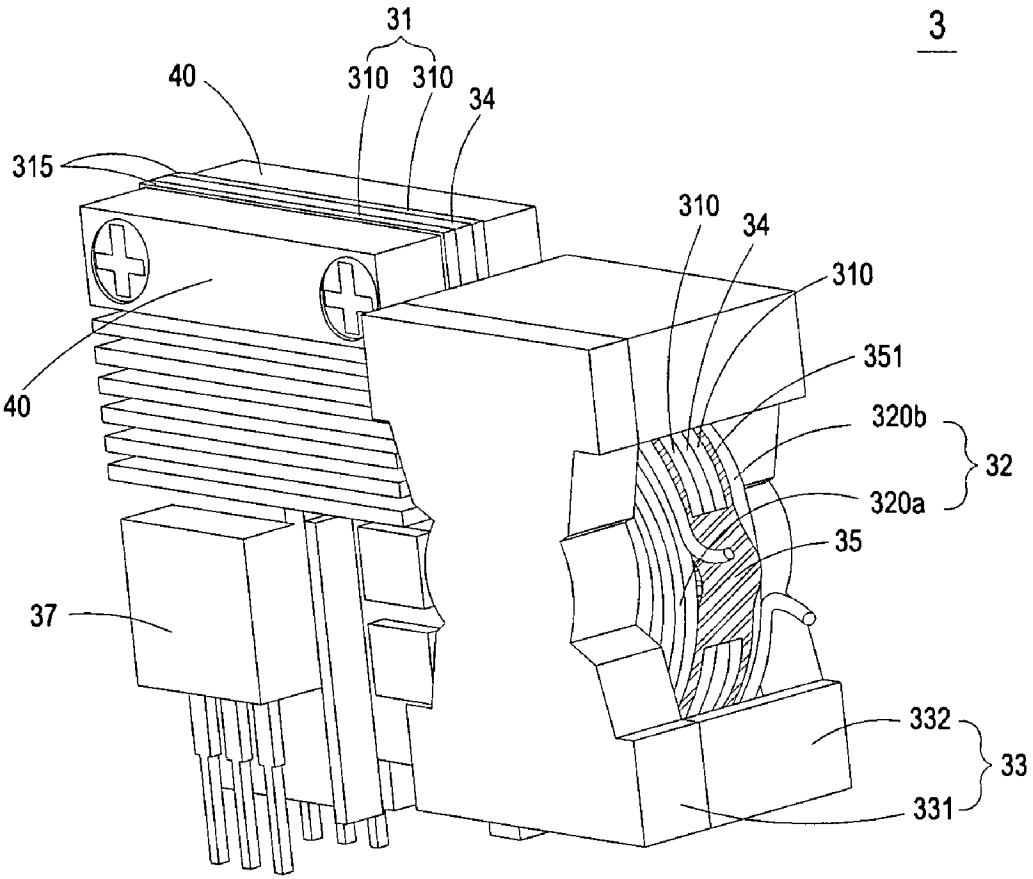
FIG. 5 is a schematic illustration showing a transformer assembly according to another preferred embodiment of the present invention.

Please refer to FIG. 5, which is a schematic illustration showing a transformer assembly according to another preferred embodiment of the present invention. In this embodiment as shown in FIG. 5, the transformer 3 also includes a first electrical conductor 31, a second electrical conductor 32, a core set 33 and a circuit board 34, wherein the structures and the functions of the first electrical conductor 31, the second electrical conductor 32, the core set 33 and the circuit board 34 are similar to those of the foresaid embodiment and thus are not redundantly described here. The difference is that the first electrical conductor 31 comprises a plurality of conductive sheets 310, and each conductive sheet 310 has similar structure and function as that of the foresaid embodiment. In this embodiment, the circuit board 34 is disposed between the plurality of conductive sheets 310 of the first electrical conductor 31 and also disposed between the plurality of spiral coils 320*a*, 320*b* of the second electrical conductor 32. After the first core 331 and the second core 332 of the core set 33 are assembled, the central protrusion penetrates the through holes of the first electrical conductor 31, the second electrical conductor 32 and the circuit board 34. Besides, the extension parts 315 of the conductive sheets 310 of the first electrical conductor 31 have heat sinks 40 disposed thereon for heat-dissipation. Also, the extension parts 315 of the conductive sheets 310 of the first electrical conductor 31 may have at least one electronic component 37, such as a transistor, disposed thereon to facilitate the fixing and heat-dissipation of the electronic component 37. In this embodiment, the transformer 3 further comprises a bobbin 35, and the plurality of spiral coils 320*a*, 320*b* of the second electrical conductor 32 are disposed at two outsides of the bobbin 35. Moreover, the bobbin 35 has a slit 351 for receiving portions of the circuit board 34 and the plurality of conductive sheets 310 of the first electrical conductor 31. The core set 33 covers at least one portion of the bobbin 35, and the central protrusion of the core set 33 penetrates the bobbin 35, thereby assembling the transformer 3 of this embodiment.

In conclusion, the transformer provided in the present invention employs a single conductive wire to form the plurality of spiral coils of the second electrical conductor, which reduces the assembling time and cost, and increases efficiency of the transformer. On the other hand, the assembling of the first electrical conductor, the second electrical conductor and the circuit board in the present invention achieves the objects of saving space, increasing application and improving heat-dissipation.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a first electrical conductor having a through hole;

a second electrical conductor electromagnetically coupled with said first electrical conductor and comprising a plurality of spiral coils formed by winding a single conductive wire, each spiral coil having a through hole;

a single circuit board having a single through hole and a single extension part; and a single core set penetrating said through hole of said first electrical conductor, said single through hole of said single circuit board, and said through holes of said plurality of spiral coils of said second electrical conductor, and covering at least one portion of said first electrical conductor and said second electrical conductor;

wherein said single extension part of said single circuit board is exposed outside said single core set and has a heat sink directly disposed on a surface of said single extension part of said single circuit board for facilitating heat-dissipation of said transformer and said single circuit board.

2. The transformer according to claim 1 wherein said first electrical conductor comprises at least one conductive sheet.

3. The transformer according to claim 2 wherein said conductive sheet is disposed between said plurality of spiral coils of said second electrical conductor.

4. The transformer according to claim 2 wherein said conductive sheet is made of copper.

5. The transformer according to claim 2 wherein said conductive sheet comprises a coil part and said through hole.

6. The transformer according to claim 5 wherein said conductive sheet further comprises two pins and an extension part, said extension part is integrally formed and connected with said coil part and exposed outside said single core set, and said two pins are respectively connected with said coil part and said extension part.

7. The transformer according to claim 6 wherein said extension part has at least one electronic component disposed thereon for facilitating fixing and heat-dissipation of said electronic component.

8. The transformer according to claim 1 wherein said first electrical conductor comprises a plurality of conductive sheets.

9. The transformer according to claim 8 wherein said plurality of conductive sheets are disposed between said plurality of spiral coils of said second electrical conductor.

10. The transformer according to claim 8 wherein said single circuit board is disposed between said plurality of conductive sheets of said first electrical conductor and between said plurality of spiral coils of said second electrical conductor.

11. The transformer according to claim 1 wherein said plurality of spiral coils of said second electrical conductor comprises at least one multilayer spiral coil.

12. The transformer according to claim 1 wherein said single core set comprises a first core and a second core.

13. The transformer according to claim 12 wherein said single core set has a protrusion penetrating said through hole of said first electrical conductor, said single through hole of said single circuit board, and said through holes of said plurality of spiral coils of said second electrical conductor.

14. The transformer according to claim 1 wherein said first electrical conductor is used as a secondary coil of said transformer and said second electrical conductor is used as a primary coil of said transformer.

15. The transformer according to claim 1 wherein said single conductive wire for forming said plurality of spiral coils of said second electrical conductor is a continuous single-core wire.

16. The transformer according to claim 1 wherein said plurality of spiral coils comprise a first spiral coil and a second spiral coil, each having a through hole, and said first spiral coil and said second spiral coil are directly connected via a connection part.

17. The transformer according to claim 16 wherein said single circuit board is disposed between said first spiral coil and said second spiral coil of said second electrical conductor and close to said first electrical conductor.

18. The transformer according to claim 1 further comprising a bobbin, wherein said plurality of spiral coils of said second electrical conductor are disposed at two outsides of said bobbin, and said single core set penetrates said bobbin and covers at least one portion of said bobbin.

19. The transformer according to claim 18 wherein said bobbin has a slit for receiving portions of said single circuit board and said first conductor.

* * * * *